US008583024B2

(12) United States Patent
Marasco et al.

(10) Patent No.: US 8,583,024 B2
(45) Date of Patent: Nov. 12, 2013

(54) METHOD AND APPARATUS FOR LIFTING AN ELEVATOR PLATE OF A MEDIA TRAY IN AN IMAGE PRODUCTION DEVICE

(75) Inventors: Joseph Marasco, Fairport, NY (US); Todd Maurice Uthman, Rochester, NY (US); Adam D. Ledgerwood, Geneva, NY (US)

(73) Assignee: Xerox Corporation, Norwalk, CT (US)

( * ) Notice: Subject to any disclaimer, the term of this patent is extended or adjusted under 35 U.S.C. 154(b) by 533 days.

(21) Appl. No.: 12/723,927

(22) Filed: Mar. 15, 2010

(65) Prior Publication Data

US 2011/0222092 A1 Sep. 15, 2011

(51) Int. Cl.
*G03G 15/00* (2006.01)
*B65H 1/08* (2006.01)

(52) U.S. Cl.
USPC ..... 399/393; 271/126; 271/148

(58) Field of Classification Search
USPC ..... 399/393; 271/3.08, 126, 127, 147, 148, 271/152–155
See application file for complete search history.

(56) References Cited

U.S. PATENT DOCUMENTS 3,260,521 A 7/1966 Moxness
5,236,348 A * 8/1993 Fetherolf et al. ..... 400/703
5,419,645 A 5/1995 Russo
5,716,046 A * 2/1998 Katamoto et al. ..... 271/3.08
7,267,337 B2 9/2007 Moore et al.
7,411,205 B2 8/2008 Amarakoon et al.
7,669,846 B1 3/2010 Hoover et al.
7,931,266 B2 * 4/2011 Okamoto ..... 271/126
8,010,035 B2 * 8/2011 Furushige ..... 399/393
2006/0157915 A1 * 7/2006 Ogawa ..... 271/126
2006/0208414 A1 9/2006 Amarakoon et al.
2007/0102870 A1 5/2007 Moore et al.

* cited by examiner

*Primary Examiner* — Judy Nguyen
*Assistant Examiner* — Justin Olamit
(74) *Attorney, Agent, or Firm* — Ronald E. Prass, Jr.; Prass LLP

(57) ABSTRACT

A method and apparatus for lifting an elevator plate of a media tray in an image production device is disclosed. The method may include receiving a request to print a print job using stacked media from one of one or more media trays, initiating lifting of the leading edge of the elevator plate so that the stacked media may be received by the one or more feeder rollers, initiating printing of the requested print job from the one of one or more media trays, determining if the amount of stacked media in the one of the one or more media trays is less than a predetermined amount, wherein if it is determined that the amount of stacked media in the one of the one or more media trays is less than the predetermined amount, initiating lifting of both of the leading and trailing edge of the elevator plate so that the stacked media may be received by the one or more feeder rollers.

21 Claims, 11 Drawing Sheets

METHOD AND APPARATUS FOR LIFTING AN ELEVATOR PLATE OF A MEDIA TRAY IN AN IMAGE PRODUCTION DEVICE

BACKGROUND

Disclosed herein is a method for lifting an elevator plate of a media tray in an image production device, as well as corresponding apparatus and computer-readable medium.

Typical low speed, low cost image production devices use a semi-active retard (SAR) type feeders to feed media in their low capacity (500 sheet) media feed trays. This type of feeder uses a nudger roll to push the top sheet into the take away roll (TAR). The two basic designs for lifting an elevator plate in a media feed tray in this market segment are: 1) where the leading edge of the elevator plate is rotated up toward the feeder rollers with pivots at the trailing edge (lower cost); and 2) the entire elevator plate is lifted vertically.

However, with a rotating angled elevator plate, a problem occurs with the leading edge of the elevator plate when heavy weight media is used where the inherent stiffness of the media causes stubbing at the feeder roller entrance at the high angle (e.g., the media tray is almost empty). This problem can be further magnified if the media has up-curl. For example, with a vertically lifted elevator plate, a stronger motor is required to lift the weight of the entire media stack instead of just a portion of the stack. The stronger motor adds to higher costs, size and design issues of the image production device.

SUMMARY

A method and apparatus for lifting an elevator plate of a media tray in an image production device is disclosed. The method may include receiving a request to print a print job using stacked media from one of one or more media trays, the one of the one or more media trays having an elevator plate that lifts the stacked media so that it may be received by one or more feeder rollers that feed media to an image production section of the image production device, the elevator plate having a leading edge that is adjacent to the one or more feeder rollers and a trailing edge which is on an end of the one of the one or more media trays opposite that of the leading edge, initiating lifting of the leading edge of the elevator plate so that the stacked media may be received by the one or more feeder rollers, initiating printing of the requested print job from the one of one or more media trays, determining if the amount of stacked media in the one of the one or more media trays is less than a predetermined amount, wherein if it is determined that the amount of stacked media in the one of the one or more media trays is less than the predetermined amount, initiating lifting of both of the leading and trailing edge of the elevator plate so that the stacked media may be received by the one or more feeder rollers.

DETAILED DESCRIPTION

Figure 1:
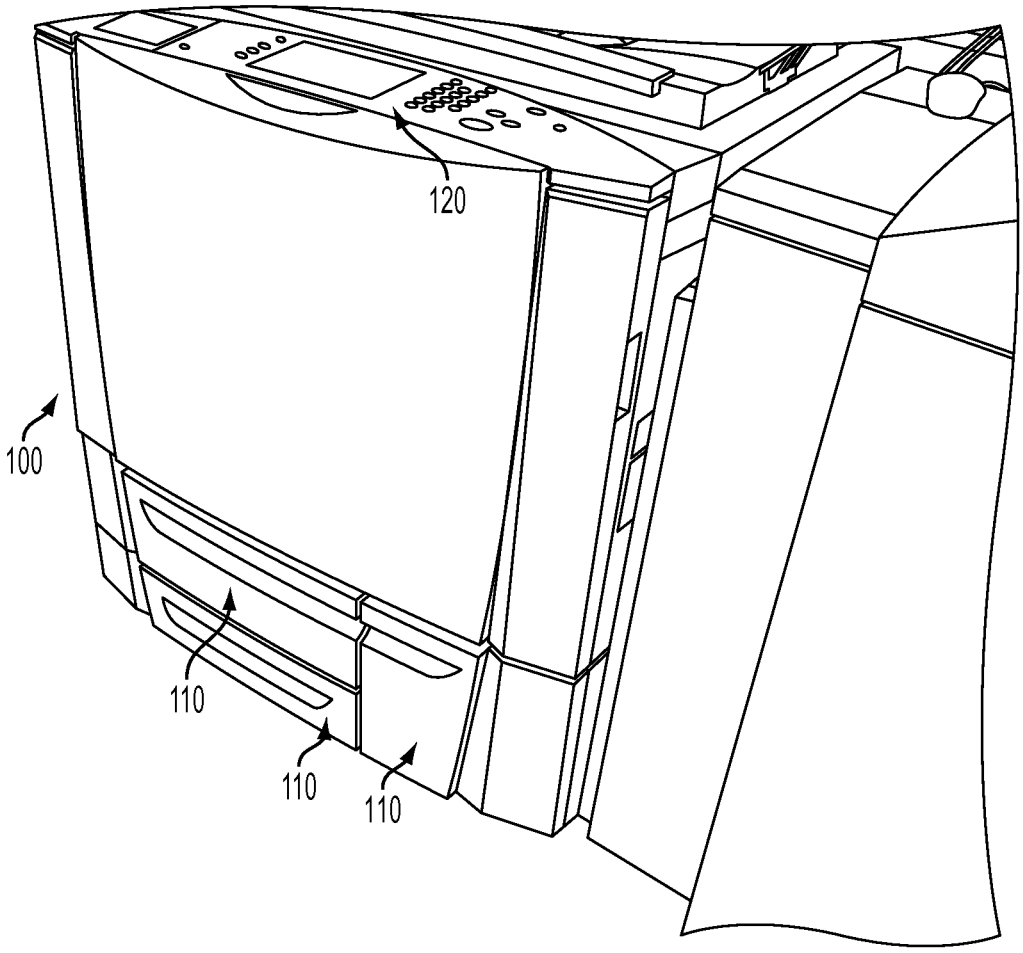
FIG. 1 is an exemplary diagram of an image production device in accordance with one possible embodiment of the disclosure.

Aspects of the embodiments disclosed herein relate to a method for lifting an elevator plate of a media tray in an image production device, as well as corresponding apparatus and computer-readable medium.

The disclosed embodiments may include a method for lifting an elevator plate of a media tray in an image production device. The method may include receiving a request to print a print job using stacked media from one of one or more media trays, the one of the one or more media trays having an elevator plate that lifts the stacked media so that it may be received by one or more feeder rollers that feed media to an image production section of the image production device, the elevator plate having a leading edge that is adjacent to the one or more feeder rollers and a trailing edge which is on an end of the one of the one or more media trays opposite that of the leading edge, initiating lifting of the leading edge of the elevator plate so that the stacked media may be received by the one or more feeder rollers, initiating printing of the requested print job from the one of one or more media trays, determining if the amount of stacked media in the one of the one or more media trays is less than a predetermined amount, wherein if it is determined that the amount of stacked media in the one of the one or more media trays is less than the predetermined amount, initiating lifting of both of the leading and trailing edge of the elevator plate so that the stacked media may be received by the one or more feeder rollers.

The disclosed embodiments may further include an image production device that may include one or more feeder rollers that feed media on which image data is to be printed, one or more media trays that contain media on which image data is to be printed and contains an elevator plate that lifts the stacked media so that it may be received by the one or more feeder rollers that feed media to an image production section of the image production device, the elevator plate having a leading edge that is adjacent to the one or more feeder rollers and a trailing edge which is on an end of the one of the one or more media trays opposite that of the leading edge, and a media tray elevator plate control unit that receives a request to print a print job using stacked media from one of one or more media trays, initiates lifting of the leading edge of the elevator plate so that the stacked media may be received by the one or more feeder rollers, initiates printing of the requested print job from the one of one or more media trays, determines if the amount of stacked media in the one of the one or more media trays is less than a predetermined amount, wherein if the media tray elevator plate control unit determines that the amount of stacked media in the one of the one or more media trays is less than the predetermined amount, the media tray elevator plate control unit initiates lifting of both of the leading and trailing edge of the elevator plate so that the stacked media may be received by the one or more feeder rollers.

The disclosed embodiments may further include a computer-readable medium storing instructions for controlling a computing device for lifting an elevator plate of a media tray in an image production device. The instructions may include receiving a request to print a print job using stacked media from one of one or more media trays, the one of the one or more media trays having an elevator plate that lifts the stacked media so that it may be received by one or more feeder rollers that feed media to an image production section of the image production device, the elevator plate having a leading edge that is adjacent to the one or more feeder rollers and a trailing edge which is on an end of the one of the one or more media trays opposite that of the leading edge, initiating lifting of the leading edge of the elevator plate so that the stacked media may be received by the one or more feeder rollers, initiating printing of the requested print job from the one of one or more media trays, determining if the amount of stacked media in the one of the one or more media trays is less than a predetermined amount, wherein if it is determined that the amount of stacked media in the one of the one or more media trays is less than the predetermined amount, initiating lifting of both of the leading and trailing edge of the elevator plate so that the stacked media may be received by the one or more feeder rollers.

The disclosed embodiments may concern lifting an elevator plate of a media tray using a combination of a rotating and vertical lift design for the elevator plate. A low cost motor may start the upward lift of the leading edge of the elevator plate thru a crank assembly. The motor may then lift the trailing edge of the elevator plate by the use of a three-bar linkage, for example. A crank and lever design may allow a delay for when the trailing edge of the elevator plate is to be lifted.

In this manner, the disclosed embodiments may allow a lower cost motor to start the lift action of the elevator plate because the motor does not have to lift the entire weight of the media stack, which in turn may reduce the required torque on the motor. The trailing edge lever on the trailing edge crank assembly may be designed with a slot that may not allow a pin in a crank linkage bracket in the crank assembly to rotate the trail edge crank assembly until after a predetermined amount of the media has been fed The predetermined amount may be approximately half of the media stack, for example.

The trailing edge crank assembly may have two lift plates that engage the elevator plate for stabilization while the elevator plate is being lifted. The trailing edge crank assembly may lift the media stack to correct any issues in the feed angle of the top sheet but only after the weight of the media stack has been reduced significantly. The process of the disclosed embodiments reduce the torque transmitted back to the motor allowing for a smaller and cheaper motor to be used. Thus, the delayed trailing edge lift of media tray may limit torque requirements on elevator motor. In addition, the disclosed embodiments may provide a lower cost and a process of improving in-tray feeding of large, heavyweight substrates, as well as potentially providing more latitude for media sheets with up-curl.

FIG. 1 is an exemplary diagram of an image production device 100 in accordance with one possible embodiment of the disclosure. The image production device 100 may be any device that may be capable of making image production documents (e.g., printed documents, copies, etc.) including a copier, a printer, a facsimile device, and a multi-function device (MFD), for example.

The image production device 100 may include one or more media tray doors 110 and a local user interface 120. The one or more media tray doors 110 may provide access to one or more media trays that contain media. The one or more media tray doors 110 may be opened by a user so that media may be checked, replaced, or to investigate a media misfeed or jam, for example.

The user interface 120 may contain one or more display screen (which may be a touchscreen or simply a display, for example), and a number of buttons, knobs, switches, etc. to be used by a user to control image production device 100 operations. The one or more display screen may also display warnings, alerts, instructions, and information to a user. While the user interface 120 may accept user inputs, another source of image data and instructions may include inputs from any number of computers to which the printer is connected via a network, for example.

Figure 2:
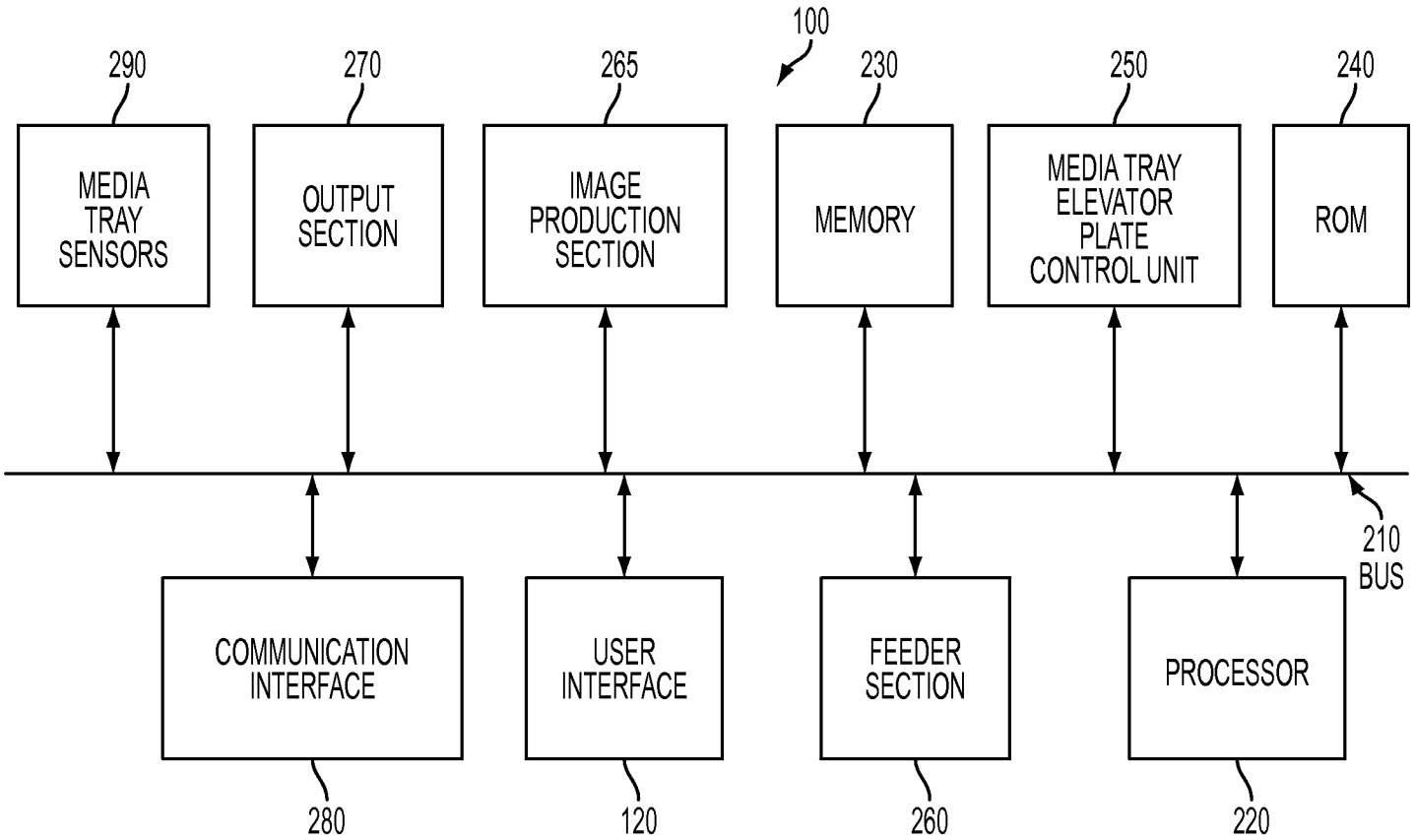
FIG. 2 is an exemplary block diagram of the image production device in accordance with one possible embodiment of the disclosure.

FIG. 2 is an exemplary block diagram of the image production device 100 in accordance with one possible embodiment of the disclosure. The image production device 100 may include a bus 210, a processor 220, a memory 230, a read only memory (ROM) 240, the media tray elevator plate control unit 250, the user interface 120, a feeder section 260, an image production section 265, an output section 270, a communication interface 280, and one or more media tray sensors 290. Bus 210 may permit communication among the components of the image production device 100.

The image production section 265 may include hardware by which image signals are used to create a desired image. The stand-alone feeder section 260 may store and dispense media sheets on which images are to be printed. The output section 270 may include hardware for stacking, folding, stapling, binding, etc., prints which are output from the image production section. If the image production device 100 is also operable as a copier, the image production device 100 may further includes a document feeder and scanner which may operate to convert signals from light reflected from original hard-copy image into digital signals, which are in turn processed to create copies with the image production section 265.

With reference to feeder section 260, the section may include one or more media trays, each of which stores a media stack or print sheets ("media") of a predetermined type (size, weight, color, coating, transparency, etc.) and may include a feeder to dispense one of the media sheets therein as instructed. The media trays may be accessed by a user by opening the one or more media tray doors 110. The one or more media tray sensors 290 may be any sensors that sense how much media is in a respective media tray. The one or more media tray door sensors may be any sensors known to one of skill in the art, such as contact, optical, infra-red, magnetic, or light-emitting diode (LED) sensors, for example.

Certain types of media may require special handling in order to be dispensed properly. For example, heavier or larger media may desirably be drawn from a media stack by use of an air knife, fluffer, vacuum grip or other application (not shown in the Figure) of air pressure toward the top sheet or sheets in a media stack. Certain types of coated media may be advantageously drawn from a media stack by the use of an application of heat, such as by a stream of hot air (not shown in the Figure). Sheets of media drawn from a media stack on a selected media tray may then be moved to the image production section 265 to receive one or more images thereon. Then, the printed sheet is then moved to output section 270, where it may be collated, stapled, folded, punched, etc., with other media sheets in manners familiar in the art.

Processor 220 may include at least one conventional processor or microprocessor that interprets and executes instructions. Memory 230 may be a random access memory (RAM) or another type of dynamic storage device that stores information and instructions for execution by processor 220. Memory 230 may also include a read-only memory (ROM) which may include a conventional ROM device or another type of static storage device that stores static information and instructions for processor 220.

Communication interface 280 may include any mechanism that facilitates communication via a network. For example, communication interface 280 may include a modem. Alternatively, communication interface 280 may include other mechanisms for assisting in communications with other devices and/or systems.

ROM 240 may include a conventional ROM device or another type of static storage device that stores static information and instructions for processor 220. A storage device may augment the ROM and may include any type of storage media, such as, for example, magnetic or optical recording media and its corresponding drive.

User interface 120 may include one or more conventional mechanisms that permit a user to input information to and interact with the image production device 100, such as a keyboard, a display, a mouse, a pen, a voice recognition device, touchpad, buttons, etc., for example. Output section 270 may include one or more conventional mechanisms that output image production documents to the user, including output trays, output paths, finishing section, etc., for example. The image production section 265 may include an image printing and/or copying section, a scanner, a fuser, etc., for example.

The image production device 100 may perform such functions in response to processor 220 by executing sequences of instructions contained in a computer-readable medium, such as, for example, memory 230. Such instructions may be read into memory 230 from another computer-readable medium, such as a storage device or from a separate device via communication interface 280.

The image production device 100 illustrated in FIGS. 1-2 and the related discussion are intended to provide a brief, general description of a suitable communication and processing environment in which the disclosure may be implemented. Although not required, the disclosure will be described, at least in part, in the general context of computer-executable instructions, such as program modules, being executed by the image production device 100, such as a communication server, communications switch, communications router, or general purpose computer, for example.

Generally, program modules include routine programs, objects, components, data structures, etc. that perform particular tasks or implement particular abstract data types. Moreover, those skilled in the art will appreciate that other embodiments of the disclosure may be practiced in communication network environments with many types of communication equipment and computer system configurations, including personal computers, hand-held devices, multi-processor systems, microprocessor-based or programmable consumer electronics, and the like that are capable of displaying the print release marking and can be scanned by the image production device 100.

Figure 3:
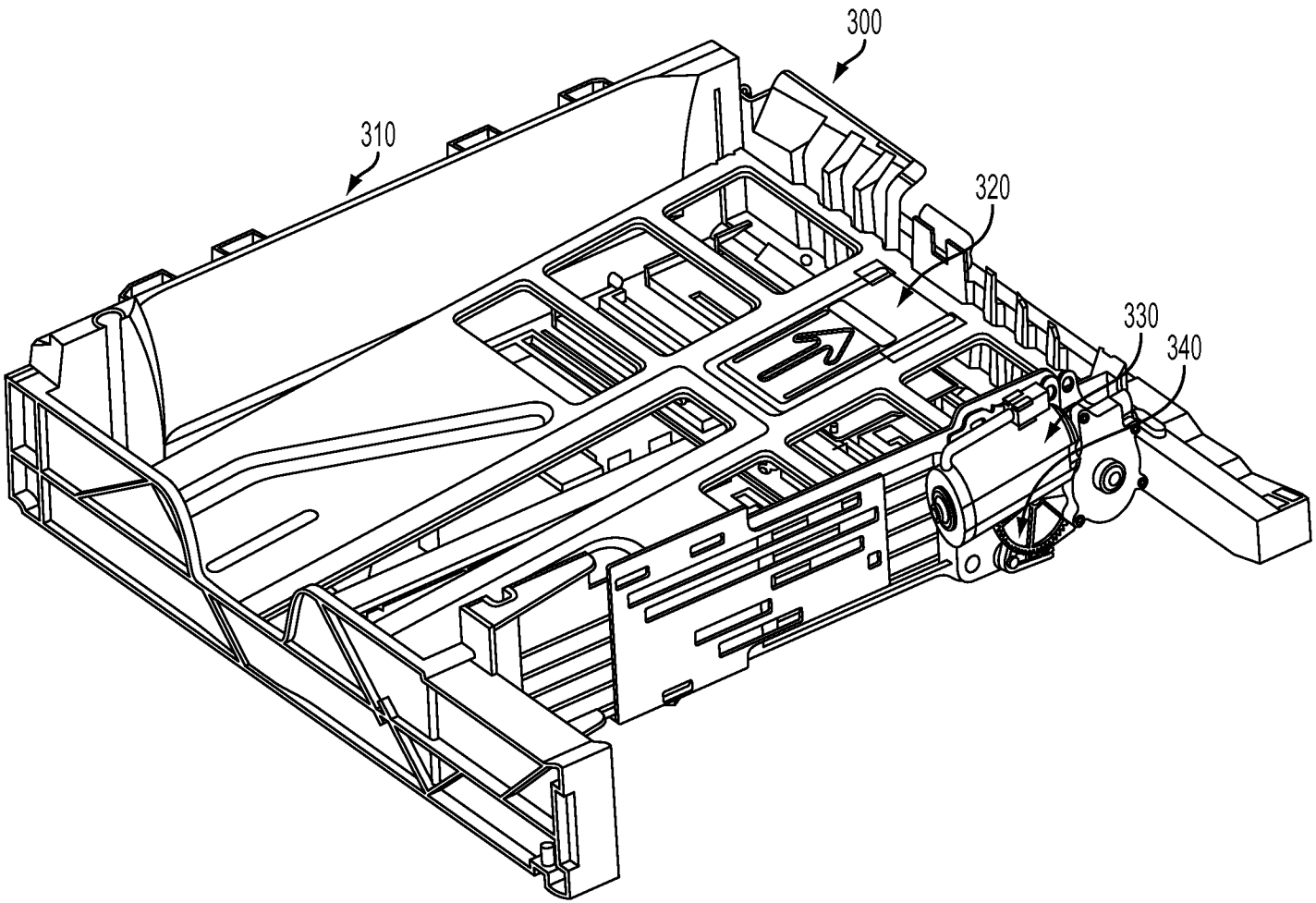
FIG. 3 is an exemplary diagram illustrating a media tray in accordance with one possible embodiment of the disclosure.

FIG. 3 is an exemplary diagram 300 illustrating one media tray 310 of the one or more media trays in the image production device 100 in accordance with one possible embodiment of the disclosure. The media tray 310 may include elevator plate 320, motor 330, and gearing 340. The motor 330 may be operable to engage and turn the gearing to enable the elevator plate 320 to lift in a manner consistent with the disclosed embodiments with the assistance of other mechanism shown in FIGS. 4 and 5, as discussed below.

Figure 4:
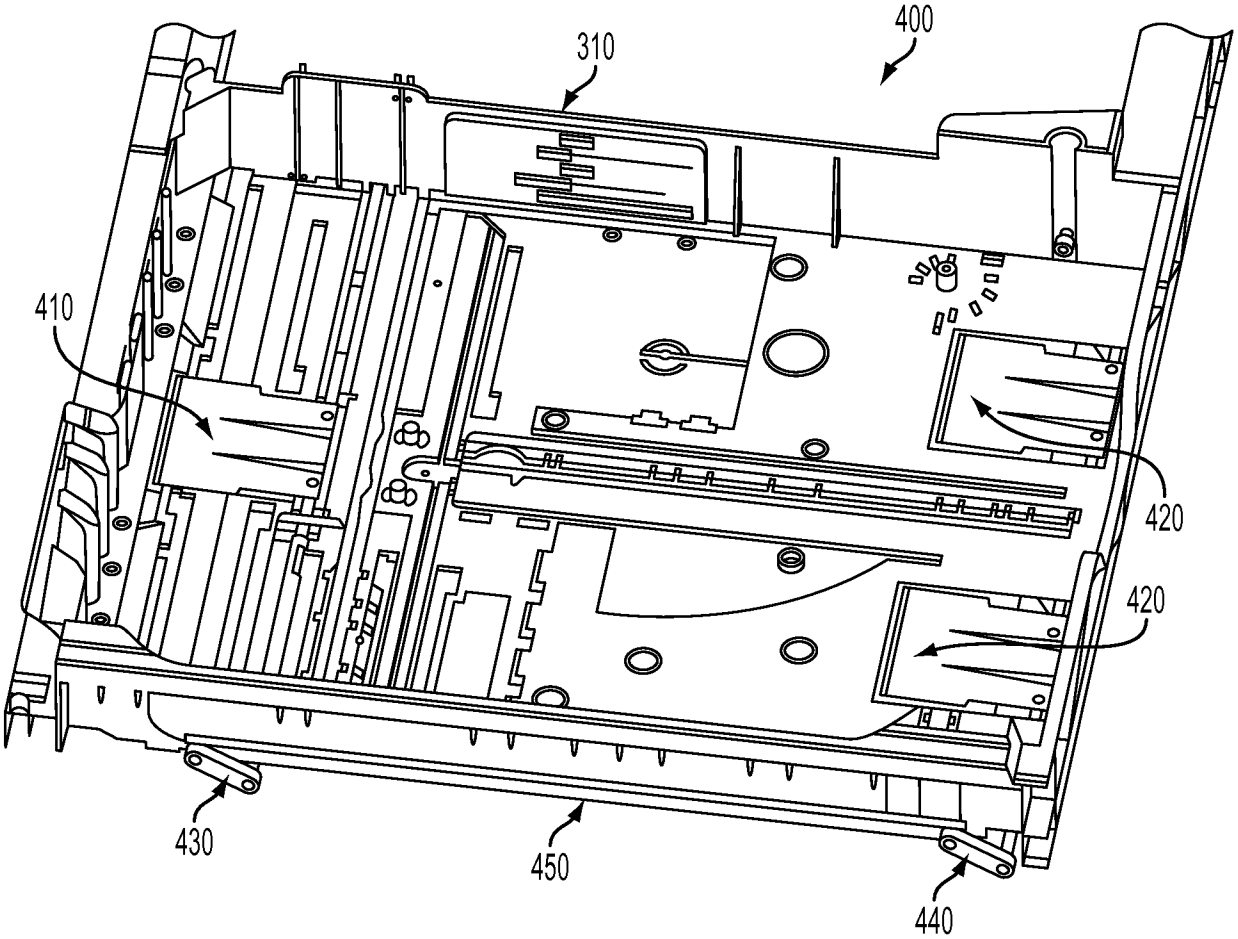
FIG. 4 is an exemplary diagram illustrating the crank assembly mechanisms of the media tray in accordance with one possible embodiment of the disclosure.

FIG. 4 is an exemplary diagram 400 illustrating the crank assembly mechanisms of the media tray 310 in accordance with one possible embodiment of the disclosure. The exemplary diagram 400 may include a media tray 310 with leading edge crank assembly plate 410, trailing edge crank assembly plates 420, leading edge lever 430, trailing edge lever 440, and crank linkage bracket 450.

The motor 330 as shown in FIG. 3 may engage and turn gearing 340 which may in turn move leading edge lever 430 which may lift the leading edge crank assembly plate 410 to lift the leading edge of the elevator plate 320. After the stacked media in the media tray 310 is determined to be less than a predetermined amount, the trailing edge lever 440 may be operable to lift the trailing edge crank assembly plates 420 to lift the trailing edge of the elevator plate 320. The predetermined amount may be determined through an electronic process and inputs from media tray sensors 290 that sense the amount of media in the media tray 310, or it may be done mechanically based on the position of the leading edge lever 430 and the configuration of the crank linkage bracket 450 and the trailing edge lever 440. For example, once the leading edge lever 430 reaches a predetermined position, the crank linkage bracket 450 may cause the trailing edge lever 440 to lift the trailing edge crank assembly plates 420.

Figure 5:
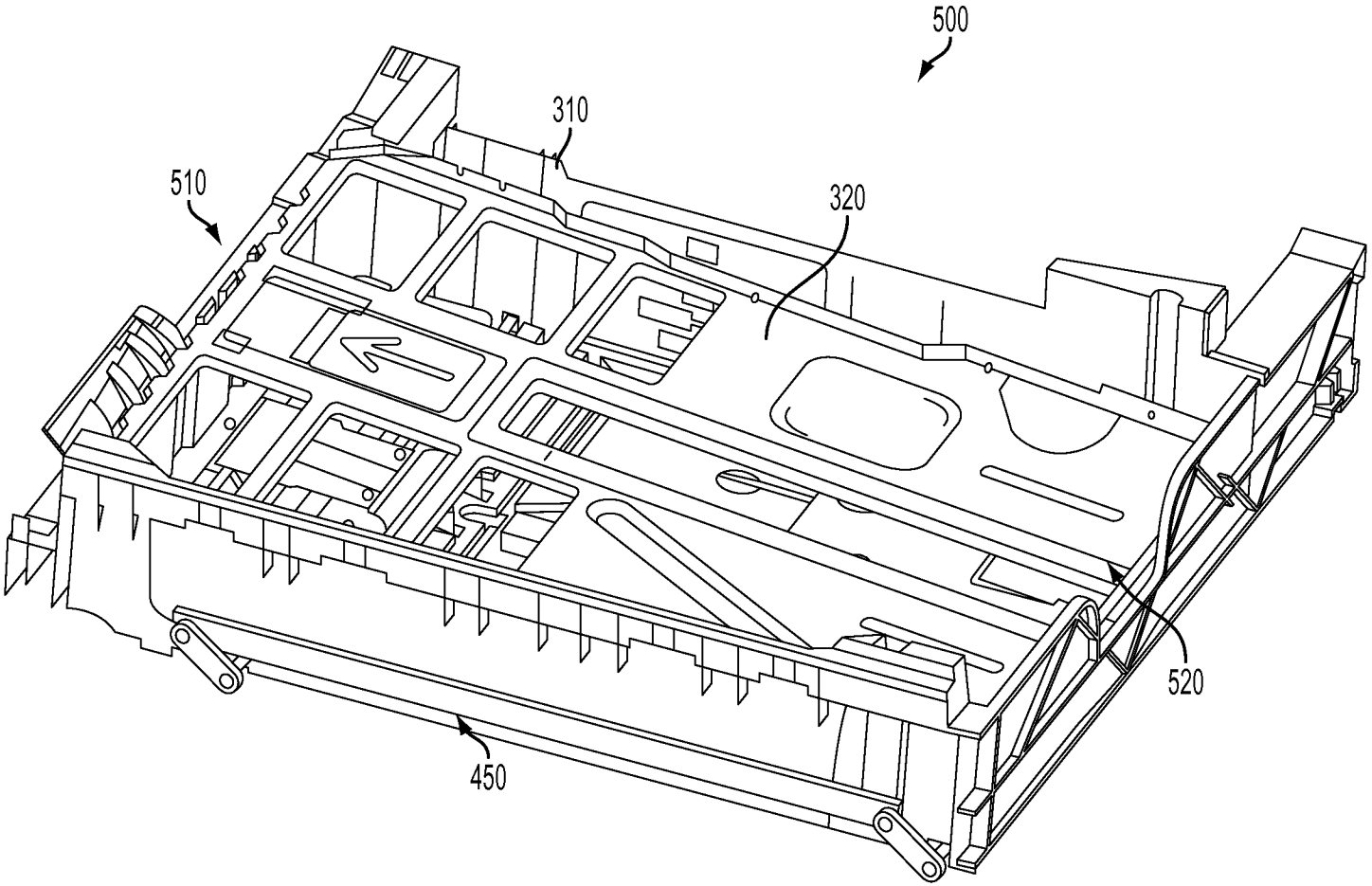
FIG. 5 is an exemplary diagram illustrating the elevator plate and crank linkage assembly in accordance with one possible embodiment of the disclosure.

FIG. 5 is an exemplary diagram 500 illustrating the elevator plate 320 and crank linkage assembly in accordance with one possible embodiment of the disclosure. The exemplary diagram 500 may include the media tray 310, elevator plate 320, and crank linkage bracket 450. The elevator plate may have a leading edge 510 and a trailing edge 520, as discussed above.

The operation of components of the media tray elevator plate control unit 250 and the elevator plate lifting process will be discussed in relation to the flowchart in FIG. 6.

Figure 6:
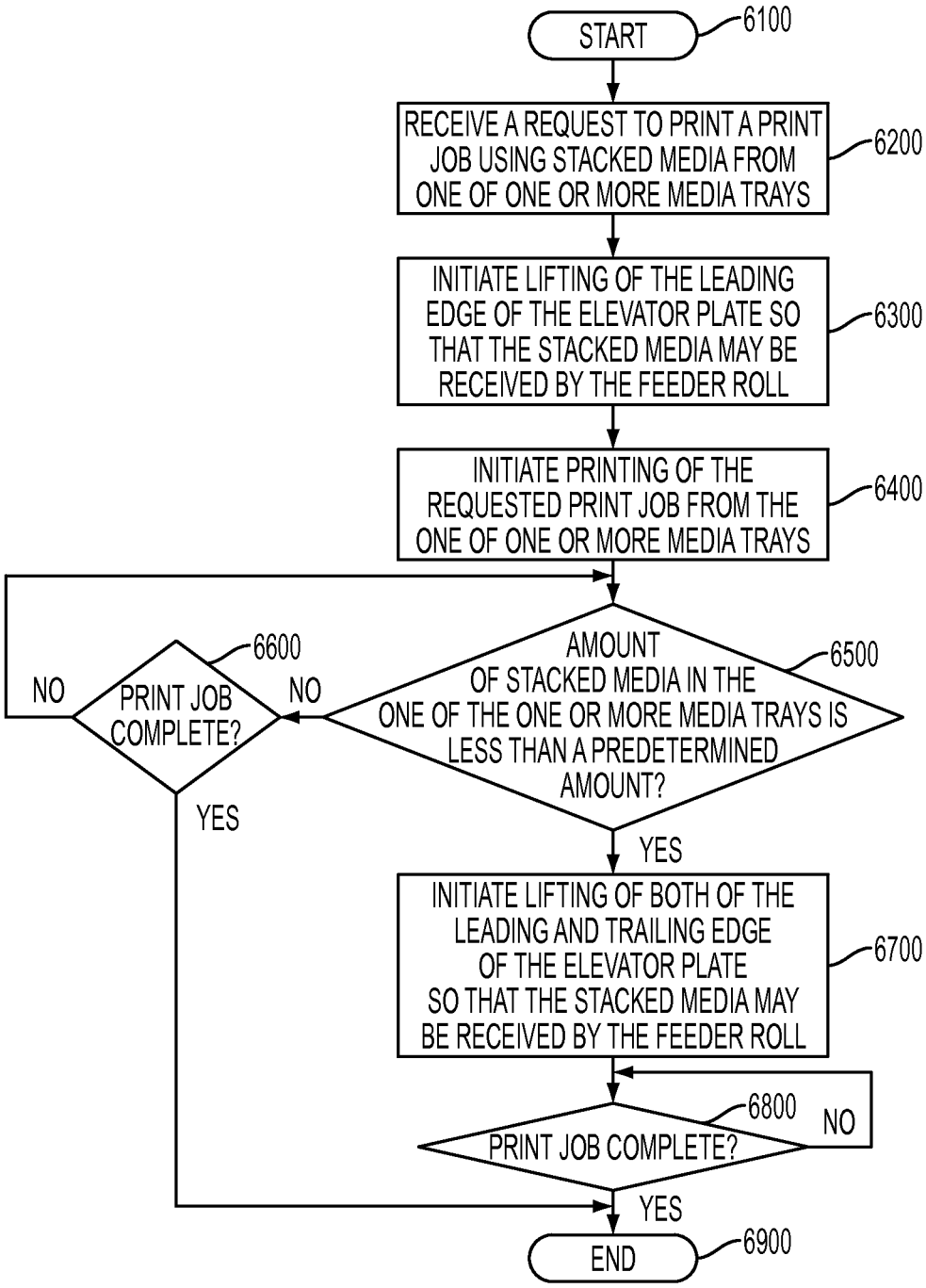
FIG. 6 is a flowchart of an exemplary an elevator plate lifting process in accordance with one possible embodiment of the disclosure.
Figure 7:
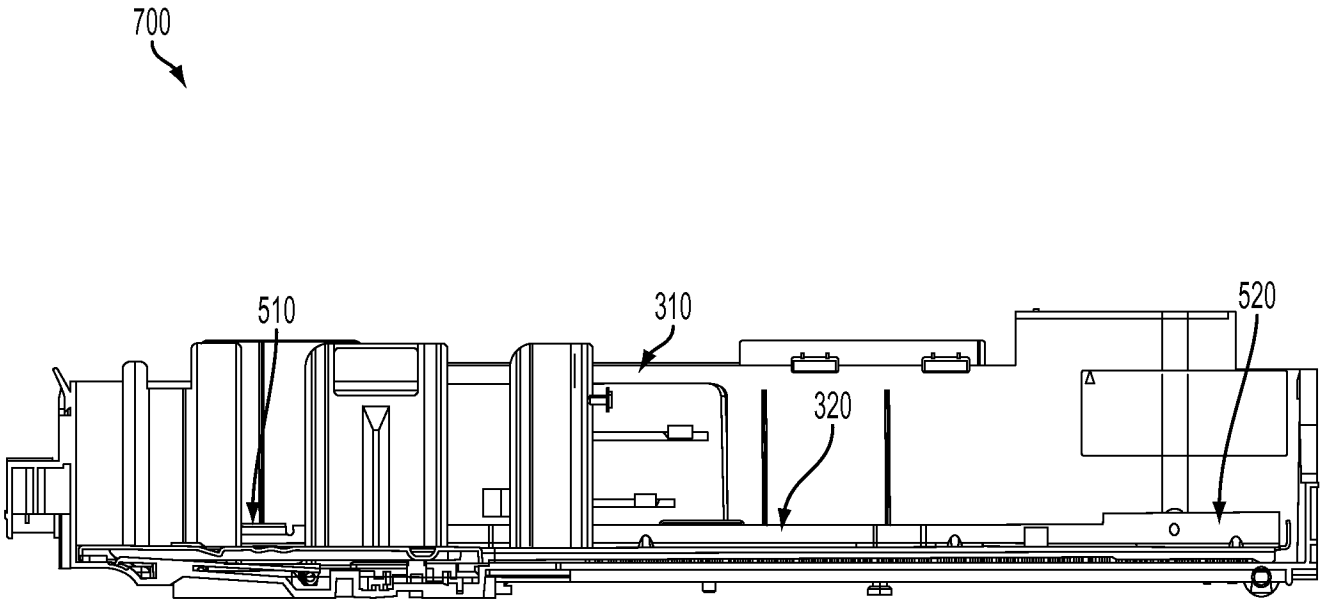
FIG. 7 is an exemplary diagram illustrating the position of elevator plate in a rest or flat position in accordance with one possible embodiment of the disclosure.

FIG. 6 is a flowchart of the elevator plate lifting process in accordance with one possible embodiment of the disclosure. The method may begin at step 6100, and may continue to step 6200 where the media tray elevator plate control unit 250 may receive a request to print a print job using stacked media from one of one or more media trays 310. At this point as shown in the exemplary diagram 700 in FIG. 7, the position of elevator plate 320 may be in a rest or flat position in the media tray 310. The media tray 310 may contain media on which image data is to be printed and contains an elevator plate 320 that lifts the stacked media so that it may be received by the one or more feeder rollers that feed media to an image production section 265 of the image production device 100. The elevator plate 320 may have a leading edge 510 that is adjacent to the one or more feeder rollers and a trailing edge 520 which is on an end of the media tray 310 opposite that of the leading edge 510.

At step 6300, the media tray elevator plate control unit 250 may initiate lifting of the leading edge 510 of the elevator plate 320 so that the stacked media may be received by the one or more feeder rollers. At step 6400, the media tray elevator plate control unit 250 may initiate printing of the requested print job from the one of one or more media trays 310.

At step 6500, the media tray elevator plate control unit 250 may determine if the amount of stacked media in the one of the one or more media trays 310 is less than a predetermined amount. The amount of stacked media in the media tray 310 may be determined by the position of the crank and lever assembly 430, 440, 450 or electronically using one or more media tray sensors 290, for example. The predetermined amount may be substantially equal to fifty percent of the one of the one or more media tray's capacity, or may be any other predetermined amount determined to lessen the motor 330 load requirement.

Figure 8:
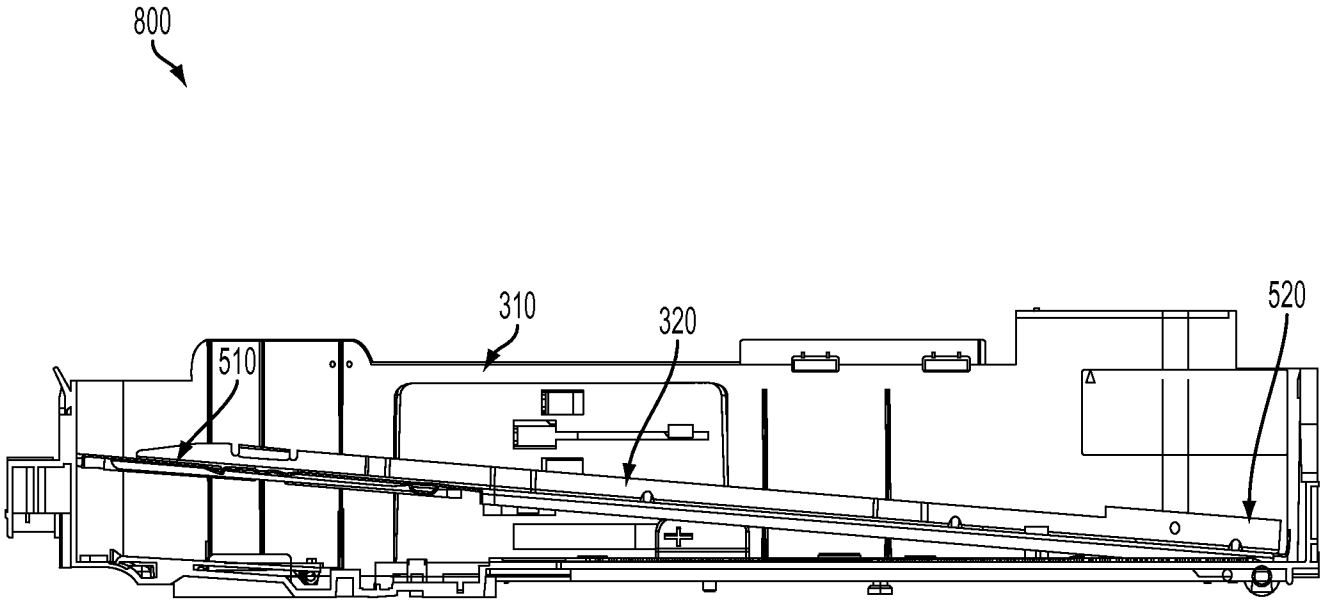
FIG. 8 is an exemplary diagram illustrating the position of the elevator plate with a full media stack during a print job in accordance with one possible embodiment of the disclosure.

If the media tray elevator plate control unit 250 determines that the amount of stacked media in the one of the one or more media trays 310 is not less than the predetermined amount, at step 6600, the media tray elevator plate control unit 250 may determine if the print job is complete. If the media tray elevator plate control unit 250 determines that the print job is complete, the process may then go to step 6900 and end. However, if the media tray elevator plate control unit 250 determines that the print job is not complete, the process may return to step 6500. As shown in the exemplary diagram 800 in FIG. 8, the position of the elevator plate 320 with a media stack during a print job. If the media stack is not less that the predetermined amount, the motor 330 may only lift the leading edge crank assembly plate 410, using the gearing 340 and the lever 430 to enable the media leading edge to reach the one or more feeder rollers.

Returning to step 6500, if the media tray elevator plate control unit 250 determines that the amount of stacked media in the one of the one or more media trays 310 is less than the predetermined amount, at step 6700, the media tray elevator plate control unit 250 may initiate lifting of both of the leading edge 510 and trailing edge 520 of the elevator plate 320 so that the stacked media may be received by the one or more feeder rollers.

Figure 9:
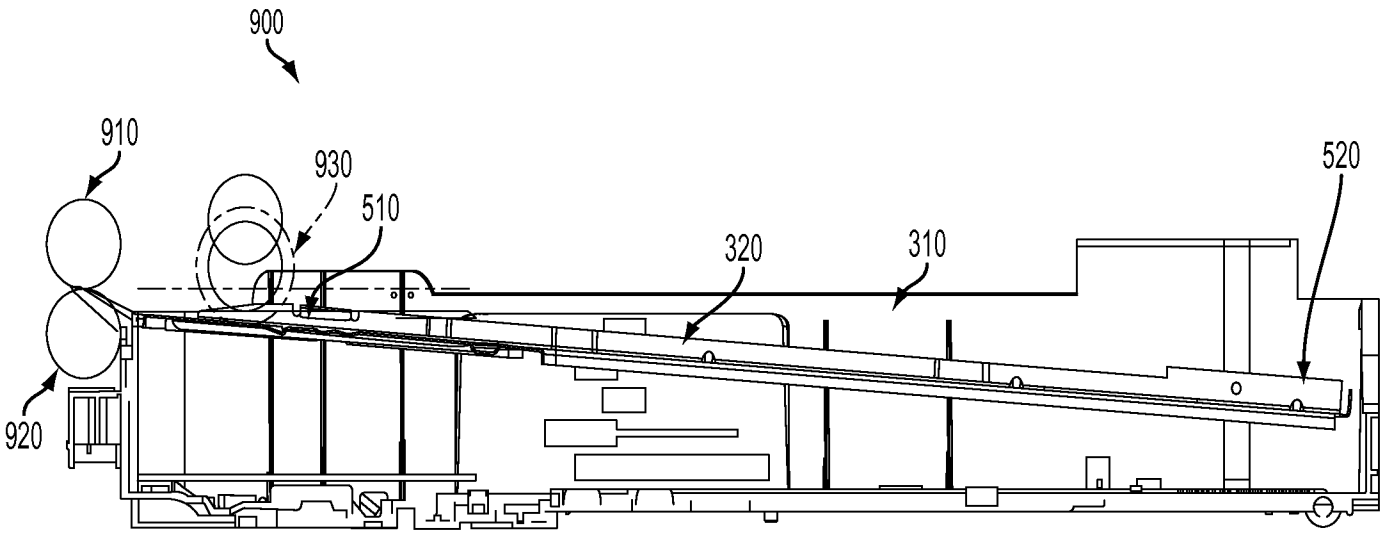
FIG. 9 is an exemplary diagram illustrating the position of the elevator plate with after a predetermined portion of the media stack has been used from the media tray during a print job in accordance with one possible embodiment of the disclosure.

FIG. 9 is an exemplary diagram 900 illustrating the position of the elevator plate 320 with after a predetermined portion of the media stack has been used from the media tray 310 during a print job in accordance with one possible embodiment of the disclosure. As shown, if the amount of stacked media is less than a predetermined amount, the motor 330 may lift the leading edge crank assembly plate 410 and the trailing crank assembly plates 420, using the gearing 340, levers 430, 440, and crank linkage bracket 450 to enable the media leading edge to reach the one or more feeder rollers 910, 920, 930. In this exemplary embodiment, the feeder rollers are shown as feeder roller 910, retard roller 920, and nudger roller 930. However, other feeder roller configurations may used as known to those of skill in the art.

At step 6800, the media tray elevator plate control unit 250 may determine if the print job is complete. If the media tray elevator plate control unit 250 determines that the print job is not complete, the process returns to step 6800. If the media tray elevator plate control unit 250 determines that the print job is complete, the process may then go to step 6900 and end.

Figure 10:
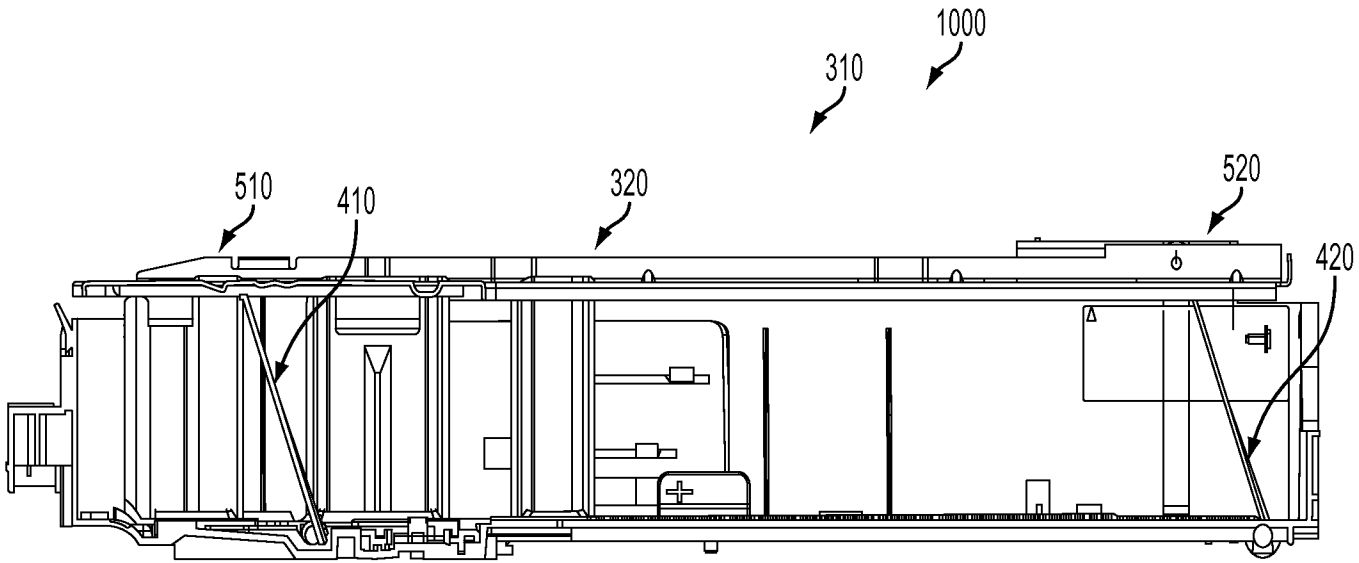
FIG. 10 is an exemplary diagram illustrating the position of the elevator plate with after the trailing edge of the media tray reaches substantially the same height as the leading edge during a print job in accordance with one possible embodiment of the disclosure.

FIG. 10 is an exemplary diagram 1000 illustrating the position of the elevator plate 320 with after the trailing edge 520 of the media tray 310 reaches substantially the same height as the leading edge 510 during a print job in accordance with one possible embodiment of the disclosure. In this embodiment, the trailing edge 520 of the elevator plate 320 would be lifted by the motor and/or crank assembly 430, 440, 450 to a position such that trailing edge 520 of the elevator plate 320 reaches substantially the same height as the leading edge 510 and not stop a portion of the way upward to a height below the leading edge 510, as shown in FIG. 9. This positioning of the trailing edge 520 may allow for more level feeding and less latitude feeding issues in some image production devices 100 as the media tray 310 reaches empty.

Figure 11:
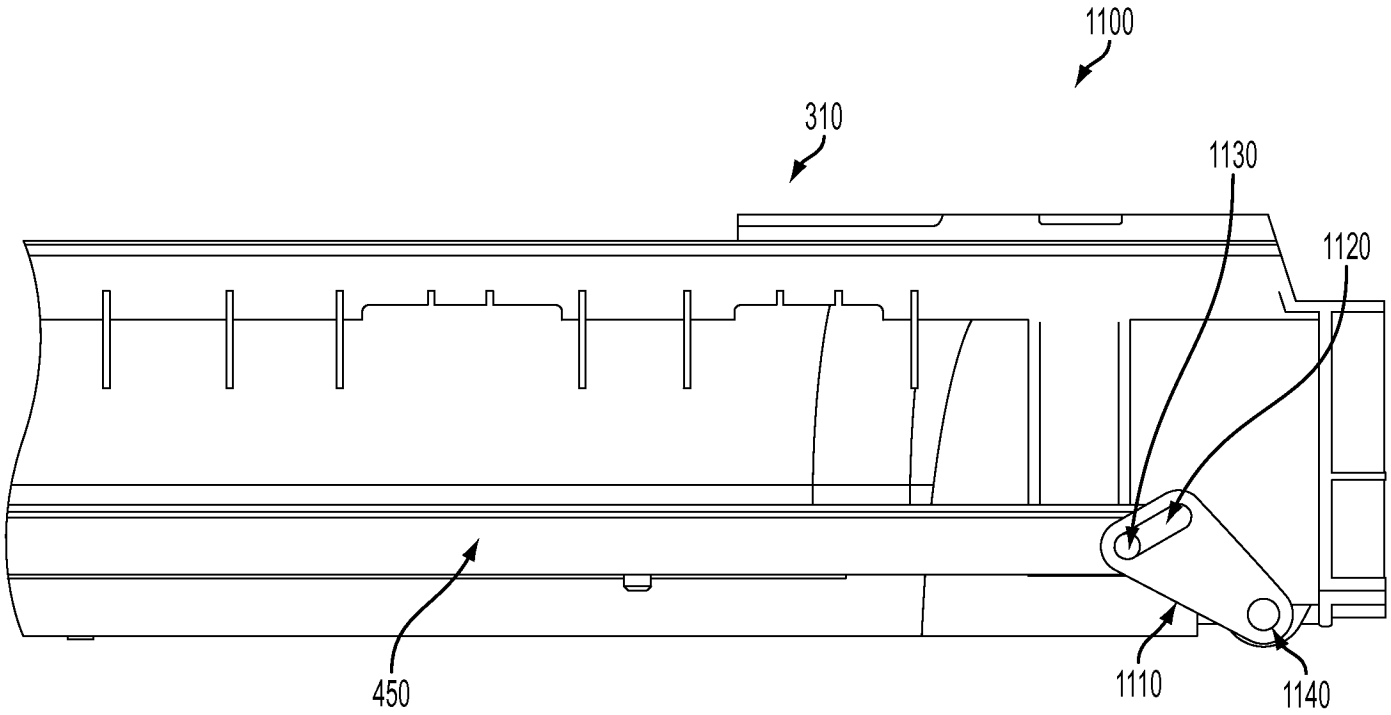
FIG. 11 is an exemplary diagram illustrating a possible slotted lever in the crank assembly mechanisms of the media tray in accordance with one possible embodiment of the disclosure.

FIG. 11 is an exemplary diagram 1100 illustrating a possible slotted lever 1110 in the crank assembly mechanisms 450, 1110 of the media tray 310 in accordance with one possible embodiment of the disclosure. This configuration may be a variant on the crank assembly mechanisms 430, 440, 450 in FIG. 4. The slotted lever 1110 may be attached to the crank and lever assembly 450, 1110 at hub 1140 and may have a slot 1120 which prevents the trailing edge 520 of the elevator plate 320 from lifting for half of the lifting cycle, thus, only lifting the leading edge 510 for the first half of the cycle. Once the crank linkage bracket 450 has traveled far enough during the leading edge 510 lift to engage the trailing edge lever 1110, the knob 1130 will reach the end of the slot and causing the trailing edge lever 1110 to rotate which enables the trailing edge crank assembly plates 420 to lift the trailing edge 520 of the elevator plate 320.

The trailing edge lever 1110 may be designed to be half the length of the leading edge lever 430, thereby making it rotate twice as quickly once it has engaged. Because of this configuration, the trailing edge lever 1110 may catch up to the leading edge lever 430 at the end of the lifting cycle, eventually creating a level media tray 310 from which media may be fed when the media tray 310 is near empty.

Embodiments as disclosed herein may also include computer-readable media for carrying or having computer-executable instructions or data structures stored thereon. Such computer-readable media can be any available media that can be accessed by a general purpose or special purpose computer. By way of example, and not limitation, such computer-readable media can comprise RAM, ROM, EEPROM, CD-ROM or other optical disk storage, magnetic disk storage or other magnetic storage devices, or any other medium which can be used to carry or store desired program code means in the form of computer-executable instructions or data structures. When information is transferred or provided over a network or another communications connection (either hard-wired, wireless, or combination thereof) to a computer, the computer properly views the connection as a computer-readable medium. Thus, any such connection is properly termed a computer-readable medium. Combinations of the above should also be included within the scope of the computer-readable media.

Computer-executable instructions include, for example, instructions and data which cause a general purpose computer, special purpose computer, or special purpose processing device to perform a certain function or group of functions. Computer-executable instructions also include program modules that are executed by computers in stand-alone or network environments. Generally, program modules include routines, programs, objects, components, and data structures, and the like that perform particular tasks or implement particular abstract data types. Computer-executable instructions, associated data structures, and program modules represent examples of the program code means for executing steps of the methods disclosed herein. The particular sequence of such executable instructions or associated data structures represents examples of corresponding acts for implementing the functions described therein. It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A method for lifting an elevator plate of a media tray in an image production device, comprising:

receiving a request to print a print job using stacked media from one of one or more media trays, the one of the one or more media trays having an elevator plate that lifts the stacked media so that it may be received by one or more feeder rollers that feed media to an image production section of the image production device, the elevator plate having a leading edge that is adjacent to the one or more feeder rollers and a trailing edge which is on an end of the one of the one or more media trays opposite that of the leading edge;

initiating lifting of the leading edge of the elevator plate so that the stacked media may be received by the one or more feeder rollers;

initiating printing of the requested print job from the one of one or more media trays;

determining if the amount of stacked media in the one of the one or more media trays is less than a predetermined amount, wherein if it is determined that the amount of stacked media in the one of the one or more media trays is less than the predetermined amount, initiating lifting of both of the leading and trailing edge of the elevator plate so that the stacked media may be received by the one or more feeder rollers.

2. The method of claim 1, wherein the elevator plate is lifted using a crank and lever assembly.

3. The method of claim 2, wherein the crank and lever assembly lifts both the leading edge and trailing edge of the elevator plate.

4. The method of claim 1, wherein the amount of stacked media in the media tray is determined by the position of the crank and lever assembly.

5. The method of claim 1, wherein the predetermined amount is substantially equal to fifty percent of the one of the one or more media tray's capacity.

6. The method of claim 1, wherein the amount of stacked media in the media tray is determined by one of a contact sensor, an optical sensor, an infra-red sensor, a magnetic sensor, or a light-emitting diode (LED) sensor.

7. The method of claim 1, wherein the image production device is one of a copier, a printer, a facsimile device, and a multi-function device.

8. An image production device, comprising:

one or more feeder rollers that feed media on which image data is to be printed;

one or more media trays that contain media on which image data is to be printed and contains an elevator plate that lifts the stacked media so that it may be received by the one or more feeder rollers that feed media to an image production section of the image production device, the elevator plate having a leading edge that is adjacent to the one or more feeder rollers and a trailing edge which is on an end of the one of the one or more media trays opposite that of the leading edge; and a media tray elevator plate control unit that receives a request to print a print job using stacked media from one of one or more media trays, initiates lifting of the leading edge of the elevator plate so that the stacked media may be received by the one or more feeder rollers, initiates printing of the requested print job from the one of one or more media trays, determines if the amount of stacked media in the one of the one or more media trays is less than a predetermined amount, wherein if the media tray elevator plate control unit determines that the amount of stacked media in the one of the one or more media trays is less than the predetermined amount, the media tray elevator plate control unit initiates lifting of both of the leading and trailing edge of the elevator plate so that the stacked media may be received by the one or more feeder rollers.

9. The image production device of claim 8, wherein the elevator plate is lifted using a crank and lever assembly.

10. The image production device of claim 9, wherein the crank and lever assembly lifts both the leading edge and trailing edge of the elevator plate.

11. The image production device of claim 8, wherein the amount of stacked media in the media tray is determined by the position of the crank and lever assembly.

12. The image production device of claim 8, wherein the predetermined amount is substantially equal to fifty percent of the one of the one or more media tray's capacity.

13. The image production device of claim 8, wherein the amount of stacked media in the media tray is determined by one of a contact sensor, an optical sensor, an infra-red sensor, a magnetic sensor, or a light-emitting diode (LED) sensor.

14. The image production device of claim 8, wherein the image production device is one of a copier, a printer, a facsimile device, and a multi-function device.

15. A non-transitory computer-readable medium storing instructions for controlling a computing device for lifting an elevator plate of a media tray in an image production device, the instructions comprising:

receiving a request to print a print job using stacked media from one of one or more media trays, the one of the one or more media trays having an elevator plate that lifts the stacked media so that it may be received by one or more feeder rollers that feed media to an image production section of the image production device, the elevator plate having a leading edge that is adjacent to the one or more feeder rollers and a trailing edge which is on an end of the one of the one or more media trays opposite that of the leading edge;

initiating lifting of the leading edge of the elevator plate so that the stacked media may be received by the one or more feeder rollers;

initiating printing of the requested print job from the one of one or more media trays;

determining if the amount of stacked media in the one of the one or more media trays is less than a predetermined amount, wherein if it is determined that the amount of stacked media in the one of the one or more media trays is less than the predetermined amount, initiating lifting of both of the leading and trailing edge of the elevator plate so that the stacked media may be received by the one or more feeder rollers.

16. The computer-readable medium of claim 15, wherein the elevator plate is lifted using a crank and lever assembly.

17. The computer-readable medium of claim 16, wherein the crank and lever assembly lifts both the leading edge and trailing edge of the elevator plate.

18. The computer-readable medium of claim 15, wherein the amount of stacked media in the media tray is determined by the position of the crank and lever assembly.

19. The computer-readable medium of claim 15, wherein the predetermined amount is substantially equal to fifty percent of the one of the one or more media tray's capacity.

20. The computer-readable medium of claim 15, wherein the amount of stacked media in the media tray is determined by one of a contact sensor, an optical sensor, an infra-red sensor, a magnetic sensor, or a light-emitting diode (LED) sensor.

21. The computer-readable medium of claim 15, wherein the image production device is one of a copier, a printer, a facsimile device, and a multi-function device.

* * * * *